US005154307A

United States Patent [19]

Hauk

[11] Patent Number: 5,154,307

[45] Date of Patent: Oct. 13, 1992

[54] DEVICE FOR USE IN STORING A MATERIAL, SUCH AS A LIQUID, IN METAL BARRELS

[75] Inventor: Tore W. Hauk, Skien, Norway

[73] Assignee: Miljo og Veiservice A/S, Skien, Norway

[21] Appl. No.: 773,861

[22] PCT Filed: Mar. 6, 1990

[86] PCT No.: PCT/NO90/00046

§ 371 Date: Oct. 22, 1991

§ 102(e) Date: Oct. 22, 1991

[87] PCT Pub. No.: WO90/10579

PCT Pub. Date: Sep. 20, 1990

[30] Foreign Application Priority Data

Mar. 7, 1989 [NO] Norway ..... 890974

[51] Int. Cl.[5] ..... B65D 90/04

[52] U.S. Cl. ..... 220/403; 220/404; 220/410; 220/470

[58] Field of Search ..... 220/403, 404, 410, 413, 220/470, 461, 462

[56] References Cited

U.S. PATENT DOCUMENTS

D. 247,427 3/1978 Fagniart .
D. 308,164 5/1990 Cazes .
3,262,628 7/1966 Heisler .
3,272,373 9/1966 Alleaume et al. .
3,354,924 11/1967 Birrell et al. .
3,367,380 2/1968 Dickey .
3,450,254 6/1969 Miles .
3,638,835 2/1972 Goodrich et al. .
4,362,255 12/1982 Bond .
4,386,639 6/1983 Gable et al. .
4,413,757 11/1983 Adler .

FOREIGN PATENT DOCUMENTS 648863 1/1951 United Kingdom .
2987210 6/1961 United Kingdom .
8808401 11/1988 World Int. Prop. O. .

*Primary Examiner*—Joseph Man Fu Moy
*Attorney, Agent, or Firm*—Wenderoth, Lind & Ponack

[57] ABSTRACT

A device is used for storage and transportation of a material such as a liquid in a standard type barrel having a threaded bunghole. The device includes an impermeable flexible bag, normally made of a plastic material, of a shape and volume substantially similar to that of the barrel and intended to be inserted into the barrel through the bunghole. The flexible bag has a relatively rigid, cylindrical neck portion formed with external threads corresponding to internal threads of the barrel bunghole. After having inserted a body portion of the bag into the barrel the neck portion is tightly threaded into the barrel bunghole, the bag is filled through its neck portion and the latter closed by a lid or plug threaded into the bag neck portion. A tubular case facilitates insertion of the flexible bag through the barrel bunghole, while also serving as a package for the bag before use.

4 Claims, 2 Drawing Sheets

DEVICE FOR USE IN STORING A MATERIAL, SUCH AS A LIQUID, IN METAL BARRELS

BACKGROUND OF THE INVENTION

The present invention relates to a device for use in storing a material, such as a liquid, in a metal barrel of the type having a threaded end opening or "bunghole", particularly standard barrels of the type used in the oil industry.

Liquid waste material of a noxious or contaminant nature, such as waste oil, chemicals, etc., is normally stored in metal barrels or drums, particularly of the standard type used in the oil industry, until it can be disposed of by combustion or otherwise. Barrels used for such purpose are usually wellworn, having more or less severe damage and corrosion attacks that may lead to cracks. Consequently such barrels will tend to leak and cause contamination, particularly during transport, when the barrels are often subject to rough treatment.

An attempt to solve this problem is represented by WO, A, 88/08401, which proposes a device for use in storing a material, such as a liquid, in a metal barrel having a threaded bunghole, comprising an impervious bag of a shape and volume adapted to that of the barrel and having a relatively rigid, cylindrical neck portion adapted to be screwed into the barrel bunghole. The cylindrical neck portion of the bag has external threads mating with corresponding internal threads in the barrel bunghole, and having internal threads mating with corresponding external threads of a plug. A serious drawback of this prior device is the fact that the neck portion of the bag, when installed in a standard barrel, protrudes relatively high above the rim of the drum, thereby preventing stacking of the barrels or barrel pallets on top of each other, which is the usual way of storing industrial barrels of the standard type, as used and reused in millions upon millions of situations throughout the world.

Finnish patent publication No. 55 814 which also relates to a plastic bag serving as a lining in a metal barrel proposes a solution to such high neck problem. According to such patent, after the bag has been inserted in the metal barrel, its flexible mouth portion is secured to the barrel bunghole by clamping it between the latter and a deformable plastic ring that is hammered into the threaded barrel bunghole. Then an internally threaded tubular sleeve is forced into the plastic ring and its opening closed by a plug o the like after the bag has been filled. The filled bag is apt to rupture near its clamped mouth portion and the rather complex, multipart clamping and closing device is cumbersome in use.

Also, from GB patent No. 1 392 603 it is known to furnish an apertured drum with an internal plastic liner having a self-supporting neck passage through the drum aperture. However, such liners are for drums having detachable ends which must be removed before the liner can be inserted into the drum.

No doubt the impractibility of the various known devices as described above is the reason why they have not found any widespread use with barrels of the above standard type, in spite of the obvious demand within the field for a device to solve the above leakage problem.

SUMMARY OF THE INVENTION

The device according to the present invention is similar to that of the previously mentioned WO publication to the extent as defined above, but it differs from the prior art by the rigid threaded neck portion being integral with the bag body portion, and by the internal threads extending at the same level as and therefore being of a smaller diameter than the external threads.

Such device according to the present invention does not suffer from the above discussed shortcomings of the prior devices. By arranging the neck portion internal and external threads at the same level, the bag neck portion will extend below the rim of the barrel, and by the bag neck and body portions being integral the risk of leakage will be practically eliminated, even with roughly treated wellworn barrels. In addition the device according to the invention is surprisingly simple in use and cheap in production.

The invention is primarily developed with a view to safe storing of waste liquids as discussed above, but it is also very useful and beneficial for use in storing other forms of liquid, e.g. paint, in barrels or drums. Furthermore it may be used for other materials than liquids, e.g. pulverulent, particulate or other bulk materials. In all cases the quality of the contents of a bag device according to the invention, installed in a barrel, is protected against condensation water and contamination from the barrel walls.

The invention also comprises a tubular, longitudinally split two-piece case particularly suitable for serving as a combined package for the bag and plug and a means for inserting the bag into the barrel.

BRIEF DESCRIPTION OF THE DRAWINGS

The invention will now be described in detail with reference to the drawings in which.

DETAILED DESCRIPTION OF THE INVENTION

Figure 1:
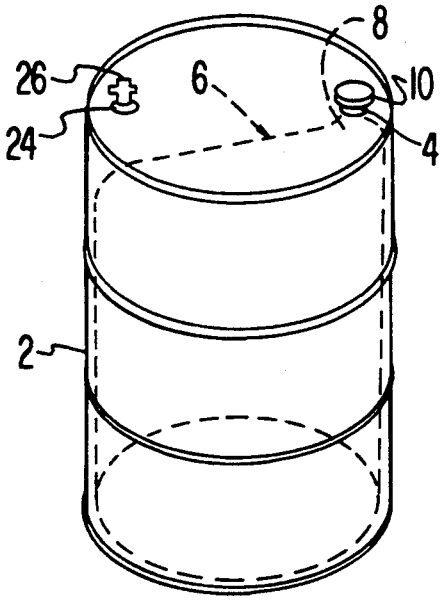
FIG. 1 is a perspective view somewhat schematically illustrating the intended use of the device according to the invention.
Figure 2:
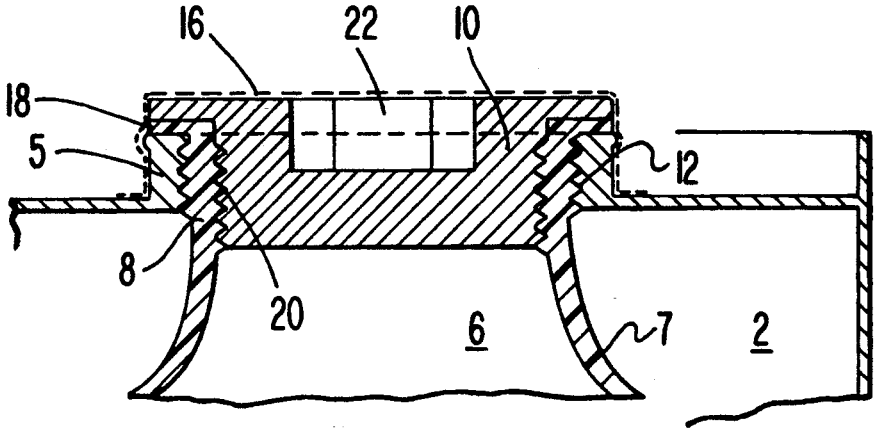
FIG. 2 is a partial sectional view, on an enlarged scale, showing details of the device according to the invention.

In FIG. 1 the numeral 2 designates a standard metal (steel) barrel of, e.g., 100 or 200 l capacity, having an internally threaded, normally 2", filling/emptying opening or "bunghole" 4 formed in the top wall thereof and surrounded by an upstanding rim 5 (FIG. 2). An impermeable, flexible bag 6, indicated with broken lines in FIG. 1, has been inserted through the barrel bunghole 4. "Impermeable" as used herein means impermeable to the material which the bag is to contain. Bag 6 has a relatively rigid, cylindric neck portion 8 integral with a bag body portion 7 (FIGS. 2 and 3) and adapted to be threaded into the bunghole 4. The bag body portion 7 has a shape and volume generally conforming to the internal cavity of the barrel, so that the walls of the bag in its expanded or filled condition in the barrel substantially contact the internal wall surface of the barrel, at least the bottom wall and the major part of the side wall. Since the bunghole 4 of such standard barrel is eccentrically located or offset near the peripheral side edge of the barrel the neck portion 8 of the bag 6, when the latter is intended for such standard barrels, will be correspondingly eccentrically located near the circular circumference of the bag in its filled condition, i.e. offset relative to the longitudinal axis of the bag 6.

FIG. 2 shows the neck portion 8 of the bag 6 threaded into the bunghole 4 and provided with an associated, threaded lid or plug 10.

The flexible bag 6 has a somewhat thickened (relative to the bag body portion 7) cylindrical neck portion 8 formed with external threads 12 mating with the internal threads of the bunghole 4 of the standard barrel 2 and extending about the same length. Also, the bag neck portion 8 is formed with an upper flange 18 having an outer diameter equal to that of the bunghole rim 5. When installed in the barrel 2 as explained above, the bag 6 can be filled with the material to be stored therein through the bag neck portion 8. Owing to its particular shape (eccentric neck portion) and flexibility the bag will substantially fill the void in the barrel, while the barrel walls form a protective casing around the filled bag.

The neck portion also comprises a set of internal threads 20 permitting the bag neck portion 8 to be closed by externally threaded lid or plug 10 having a shape substantially similar to that of the plug of the standard barrel 1 and, like the latter, having a hexagonal recess 22 for a wrench. When thus threaded into its bunghole 4 the plug 10, which preferably is plastic, will clamp the neck portion flange 18 of the bag 6 sealingly against the bunghole rim 5 as shown in FIG. 2. As an additional safety means, a seal-coating 16, indicated by dashed lines, may be applied over the plug 10 and the external circumference of the bunghole rim 5. Owing to its low height above the barrel top, the plugged neck portion 8 will not be exposed to mechanical damage more than an ordinary plugged barrel void of any internal barrel. When the neck portion is completely threaded into its bunghole as shown in FIG. 2, the bag will be properly angularly oriented in the barrel, i.e. such that the major lateral extension thereof substantially coincides with the diameter through the bunghole 4 of the barrel 1. In addition the bag neck portion 8 could be provided with a marking (not shown) which, when the bag is correctly oriented, is located opposite a corresponding marking on the barrel top.

Normally the bag 6 will be made from a relatively strong plastics material resistant to oil and chemicals, about 0.2 mm thick, typically various types of TPV, plasticized PVC or other thermoplastic elastomers could be used. The walls of the plastic bag may be reinforced, if desired, e.g. by fiberglass.

Figure 3:
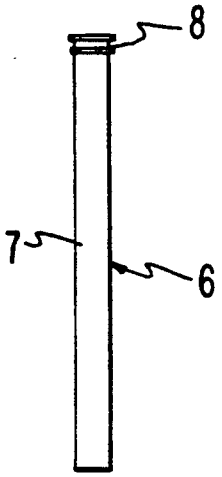
FIG. 3 is an elevation view showing the device in a convenient condition ready for use.

In order to facilitate insertion of the empty bag 6 through the bunghole 4 of the barrel, such bag may advantageously be stored and distributed in a condition in which its body portion is relatively tightly folded or rolled up in the longitudinal direction under the neck portion 8 as indicated in FIG. 3, and releasably retained in a such folded or rolled up condition by means of suitable retaining means such as tape, rubber bands or the like (not shown). Such means may be removed immediately prior to or when inserting the bag into its barrel, since the bag, owing to a certain "slowness" of the plastic material, still maintains its compact condition for a time sufficient to allow its insertion through the bunghole. However, the retaining means need not always be removed prior to insertion of the bag, since they may be caused to release or rupture after having inserted the bag into the barrel, for example by applying a pressure fluid such as air into the bag via an appropriate nipple (not shown) threaded into the bag neck opening. This also results in a complete unfolding of the bag into contact with the surrounding walls of the barrel, such that the material to be stored can easily be filled into the thus plastic lined barrel.

Figure 4:
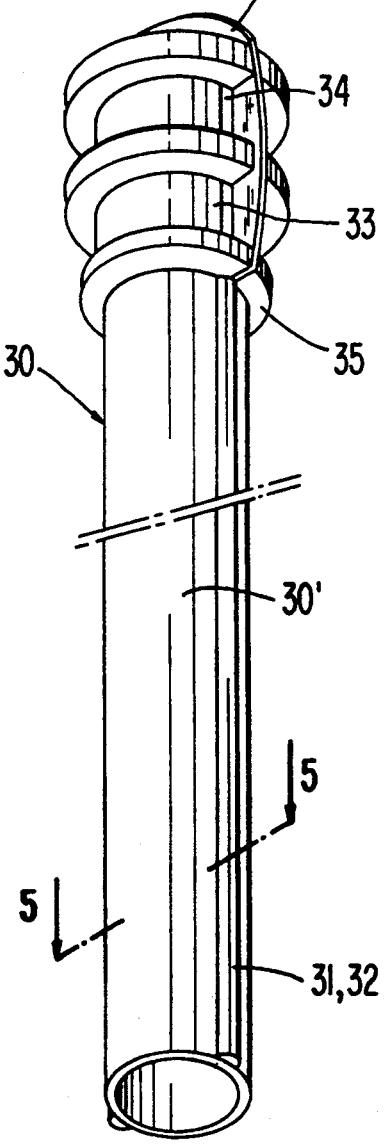
FIG. 4 is a perspective view of a tubular two-piece case facilitating insertion of a flexible bag through a barrel spunghole while also serving as a package for the bag.
Figure 6:
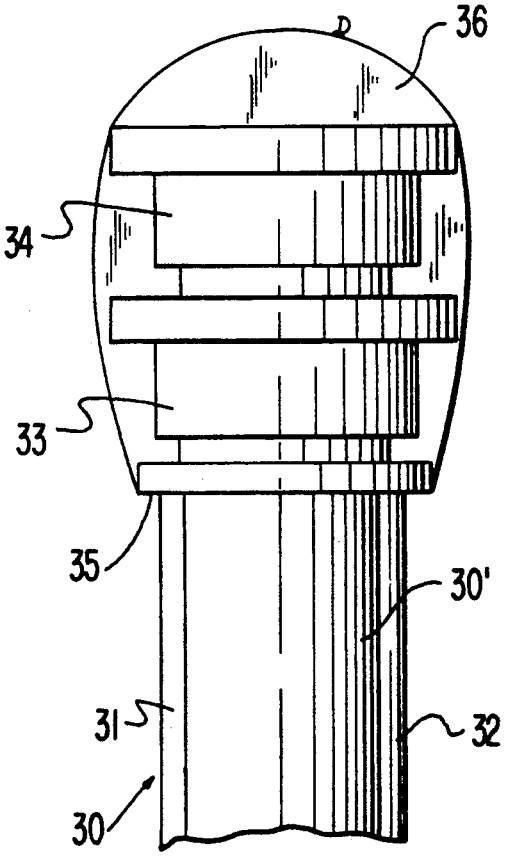
FIG. 6 is a partial elevational view showing the inside of one of the case halves.
Figure 5:
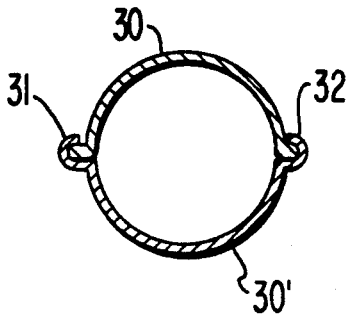
FIG. 5 is a cross-section through to the tubular case along lines 5—5 in FIG. 4.

However, according to an advantageous aspect of the device according to the invention the retaining means may include a tubular, longitudinally split cover or case 30 as shown in FIGS. 4 through 6. Each preferably identical case half 30', along at least part of two longitudinal edges thereof, is provided with means for releasable interconnection of the two halves, while permitting relative longitudinal displacement thereof. In the shown embodiment the interconnecting means are in the form of a lip 31 and slit 32 respectively.

Advantageously one end portion (the upper one in use) of the case halves 30' may be without the interconnecting means and formed with two molded chamber halves 33, 34 adapted to receive the threaded neck portion 8 of the bag 6 and the plug 10 respectively, while the remaining (lower) case portion receives the bag body portion 7. Above and below the chamber halves 33, 34 each case half 30' is formed with a radially protruding shoulder or stop 35 and a longitudinally extending pulling flap 36, respectively.

Preferably the case 30 is made from a transparent plastics material, such as a PET, PS or PVC thermoformable material with a wall thickness imparting adequate rigidity to the case while also permitting a certain lateral flexibility normal to the plane of interconnection of the two case halves.

When using the above described case 30 the bag 6 in its folded or rolled up condition is placed in one of the two case halves 30' with its rigid neck portion 8 in the chamber half 33 while a lid or plug 10 is placed in the case upper chamber half 34. Then the other, empty case half 30' is placed over the filled one and the two halves 30', 30' are joined by inserting the edge lips 31 thereof in their respective edge slits 32. The thus assembled case 30 will then form an effective package for the bag 1 with plug 10 during storage and transportation.

When bag 6 in case 30 is to be placed in a barrel 2, the tubular case 30 is inserted into the barrel through bunghole 4 until the case stop 35 abuts the upper surface of bunghole rim 5. Then the upper portions of the two casing halves 30', 30' are bent laterally apart, thus separating their respective pull flaps 36 sufficiently to allow removal of plug 10 from its chamber 34, whereupon one of the case halves 30' is pulled vertically up from the barrel while the other half 30' is left in the barrel together with the bag 1. Then the other case half 30' also can be withdrawn while the bag remains in the barrel and its neck portion 8 can be threaded into the barrel bunghole 4 and possibly inflated as previously explained. Thus, the case 30 serves both as a package for the bag 1 and plug 10 and as an aid facilitating insertion of the bag into its barrel.

Bags 6 according to the invention may be of different materials depending on the kind of material to be contained therein and advantageously they may be given correspondingly different colors. By having a transparent case as noted above it is an easy matter to select the appropriate bag for each application.

In addition to the filling/emptying opening of bunghole 4 in standard barrels 2 of the type for which the device according to the present invention is primarily intended, such barrels are also provided with a threaded 1" vent 24 (FIG. 1) which in ordinary use of such barrels normally will be open during filling and emptying of the barrel. Barrels of the type in question are conventionally emptied by progressively tilting the barrel, which is a relatively cumbersome operation often causing spillage. Alternatively special pump means may be used.

According to an advantageous aspect of the invention the vent 24 in combination with the plastic bag 6 may be utilized to implement an extremely simple, effective and controlled mode of emptying the material contained in the barrel 2 lined with the plastic bag 6. Thus, the vent 24 may be provided with a suitable connecting means or nipple for a pressure medium such as pressurized air, as indicated at 26 in FIG. 1. Then, by pressurizing the barrel through vent 24 the liquid contents of a filled bag therein will be forced out through the bag neck portion 8 located in the barrel bunghole 4. The rate of discharge may be controlled simply by controlling the pressure applied to the barrel 2 through vent 24, resulting in a complete emptying of the barrel. Any convenient means may be used as the connection means 26, but a connection means that has been found particularly suitable is a conventional, manually controlled 3/2 directional valve, such as Martonair 03040302 with appropriate adapters, etc. Alternatively the bags may be emptied by connecting a vacuum directly to the internal threads 20 of the bag neck portion 8, with vent 24 open.

I claim:

1. A one-piece device for use in storing a material, such as a liquid, in a metal barrel having a threaded bunghole, said device comprising:

an impervious bag including a body portion of a shape and volume adapted to that of the barrel, and a relatively rigid, cylindrical neck portion integral with said body portion and adapted to be screwed into the barrel bunghole;

said cylindrical neck portion of said bag having external threads to mate with corresponding internal threads in the barrel bunghole and having internal threads to mate with corresponding external threads of a plug; and said internal threads extending at the same level as and being of a smaller diameter than said external threads.

2. A device as claimed in claim 1, wherein said cylindrical neck portion has a flange located axially above said external and internal threads and adapted to be clamped between the barrel rim and peripheral flange of the plug.

3. A device as claimed in claim 1, further comprising a tubular, longitudinally split, two-piece case adapted to contain a longitudinally folded or rolled up said bag and a plug therefore, said two case halves being relatively longitudinally displacable in interconnected condition, said case serving as a package for said bag and the plug and also as a means for inserting said bag into the barrel through the barrel bunghole.

4. A device as claimed in claim 3, wherein said case is formed of a transparent plastic material.

* * * * *